US007548218B2

(12) United States Patent
Scialino

(10) Patent No.: US 7,548,218 B2
(45) Date of Patent: Jun. 16, 2009

(54) ISOSTATIC SUPPORT STRUCTURE OR FIXED OR RE-ORIENTABLE LARGE SIZE ANTENNA REFLECTORS

(75) Inventor: Giovanni Lorenzo Scialino, Rome (IT)

(73) Assignee: Finmeccanica S.p.A., Rome (IT)

( * ) Notice: Subject to any disclaimer, the term of this patent is extended or adjusted under 35 U.S.C. 154(b) by 0 days.

(21) Appl. No.: 11/993,913

(22) PCT Filed: Jun. 28, 2006

(86) PCT No.: PCT/IT2006/000502

§ 371 (c)(1),
(2), (4) Date: Feb. 22, 2008

(87) PCT Pub. No.: WO2007/000796

PCT Pub. Date: Jan. 4, 2007

(65) Prior Publication Data

US 2008/0198093 A1 Aug. 21, 2008

(30) Foreign Application Priority Data

Jun. 28, 2005 (IT) ..... RM2005A0338

(51) Int. Cl.
*H01Q 15/20* (2006.01)
*H01Q 1/08* (2006.01)

(52) U.S. Cl. ..... 343/915; 343/880; 343/881

(58) Field of Classification Search ..... 343/912, 343/915, 878, 880, 881
See application file for complete search history.

(56) References Cited

U.S. PATENT DOCUMENTS

| | | | | |
|---|---|---|---|---|
| 3,729,743 | A * | 4/1973 | Fletcher et al. | 343/915 |
| 6,323,827 | B1 * | 11/2001 | Gilger et al. | 343/915 |
| 6,448,943 | B1 * | 9/2002 | Wallach | 343/915 |
| 6,930,654 | B2 * | 8/2005 | Schmid et al. | 343/915 |
| 2003/0234746 | A1 | 12/2003 | Tang et al. | 343/781 CA |
| 2004/0244525 | A1 | 12/2004 | Gaechter | 74/490.01 |

* cited by examiner

*Primary Examiner*—Hoang V Nguyen
(74) *Attorney, Agent, or Firm*—Ladas & Parry LLP

(57) ABSTRACT

Isostatic deployable support structure for antenna reflectors for vehicles characterized in that it is constituted by six supports hinged to each of their ends in three points on the structure of the vehicle and in three points on the structure of the reflector, in which: —two out of the three points of hinging on the structure of the reflector are positioned in points that are diametrically symmetrical with respect to the plane of symmetry of the antenna optics, and the third one is positioned on the plane of symmetry of the antenna optics, at the end of the reflector that is closer to the illumination system of the reflector; —two out the three points of hinging on the structure of the vehicle are positioned in points that are symmetrical with respect to the plane of symmetry of the antenna optics, as distant as possible, in the area between the reflector and the illumination system, and the third one is positioned on the plane of symmetry of the antenna optics, above the side of the illumination system that is farther from the reflector, such that the position and the orientation of the reflector relative to the vehicle depends on the length of the 6 supports.

7 Claims, 2 Drawing Sheets

ISOSTATIC SUPPORT STRUCTURE OR FIXED OR RE-ORIENTABLE LARGE SIZE ANTENNA REFLECTORS

TECHNICAL FIELD

The invention relates to an isostatic support structure for fixed or re-orientable large size antenna reflectors. The invention relates to deployable support structures and more in particular to a deployable support system able to sustain a foldable antenna reflector aboard a space vehicle.

The evolution of satellite missions requires the use of large size reflectors. The applications are telecommunications, earth observation, scientific missions, defense.

The author has set out a light, deployable structure formed by six hinged supports, which is used to sustain a large deployable reflector aboard a satellite.

The supports are positioned around the radio frequency electromagnetic field generated by the antenna illumination system and directed towards the main reflector, so their impact on the radio frequency performance of the antenna is minimized.

The supports need only to withstand traction and compression, so their structure can be minimized.

After launch, the supports act in such a way as to deploy the reflector in the desired position relative to the satellite, can follow the configuration changes of the reflector during its deployment and lastly can move and rotate the reflector in order to reconfigure or re-orient the antenna.

STATE OF THE ART

In the space vehicles used for scientific missions in remote space or for terrestrial telecommunication services or for Earth observation, there is a requirement for radio frequency communications to be effected towards our planet with minimal energy expenditure.

In order to reduce the power required from communication amplifiers, it is necessary to use high gain antennas.

High gain antennas are characterized by large dimensions, and by the related current stowage problems during launch and before the space vehicle is inserted in the desired trajectory.

When antennas of excessively large size are proposed to be used aboard space vehicles, stowage difficulties are encountered due to the simple lack of available space.

Various attempts to overcome such difficulties have been made, such as the use of foldable antenna reflectors in various configurations.

A great effort has been made to define the architectures of the reflectors, a lesser effort has been made to define support structures for foldable reflectors that would be structurally and functionally efficient.

The configurations currently available for the support structures of large-size deployable reflectors are:

(connected at the centre of the reflector, or connected to a point of the edge of the reflector, with poor thermal and structural stability performance of the assembly.

The prior art architectures for connecting the antenna reflector to the satellite are:

a) Direct connection of the centre of the reflector to the body of the satellite, as shown in FIG. 1, which is used for centred antennas of the "onset" type. In this case, the antenna reflector is directly connected to the body of the satellite with no need for a deployable support structure.

The deployment involves only the elements of the reflector and in some case the sub-reflector.

b) Connection to the edge of the reflector structure, in a single point. This is the most widely used prior art configuration. The reflector support structure is constituted by a single beam (solid or reticular) hinged at one end to the satellite and at the other end to the reflector, as shown in FIG. 2. This configuration has the advantage of being a relatively short support structure, but it has the following drawbacks which are eliminated by the present invention:

The first deformation harmonic of the reflector (i.e. contraction at low temperatures) induces a rotation of the reflector and hence an unwanted deviation of the antenna beam, The overall stiffness of the reflector is poor and hence the orientation stability of the antenna with respect to the dynamic disturbances of the satellite is limited.

c) Connection at the centre of the reflector in one point. The support structure is constituted by various beams (solid or reticular) connected in series and hinged to the reflector, as shown in FIG. 3. This configuration is heavier than the previous configuration, but it eliminates its first drawback. This configuration still has the drawback of the poor overall stiffness of the reflector and hence the orientation stability of the antenna with respect to the dynamic disturbances of the satellite is limited. The present invention eliminates this drawback.

d) Connection of the reflector to the satellite by means of 3 supports. In this configuration the reflector is supported by three beams (solid or reticular) in three points distributed along its edge, as shown in FIG. 4. During the deployment, the joints between the three beams, the reflector and the satellite rotate. At the end of the deployment process, at least three degrees of freedom of rotation in the joints between the three beams, the reflector and the satellite will have to be locked, in order to constrain the 6 degrees of freedom of the reflector relative to the satellite. In other words, after deployment the position of the reflector is controlled by the length of the beams, by the flexural stiffness of the beams and by the flexural stiffness of the locked joints. This configuration has better performance than the previous ones because:

The first deformation harmonic of the reflector (i.e. contraction as low temperatures) does not induce a rotation of the reflector and hence an unwanted deviation of the antenna beam, The distribution of the joints on the reflector allows a greater overall stiffness. However this configuration has the following drawbacks, which are eliminated by the present invention:

To react to the orbital dynamic disturbances of the satellite, the beams are subjected to bending stress and this implies to increase the stiffness and hence the mass of the beams;

The re-orientation or the controlled displacement of the reflector requires complex mechanisms, because the position and the orientation of the reflector are determined not only by the length of the beams, but also by the rotation of the joints.

The Stewart platform is already known in the prior art, as is the configuration with 6 legs connected in pairs to ball joints positioned three on one body and three on the other.

DESCRIPTION OF THE INVENTION

The invention consists of a structure to sustain a reflector by means comprising 6 supports positioned between the satellite and the active surface of the reflector.

Therefore it is an object of the invention an isostatic deployable support structure for antenna reflectors for vehicles characterized in that it is constituted by six supports hinged to each of their ends in three points on the structure of the vehicle and in three points on the structure of the reflector, in which:

two out of the three points of hinging on the structure of the reflector are positioned in points that are diametrically symmetrical with respect to the plane of symmetry of the antenna optics, and the third one is positioned on the plane of symmetry of the antenna optics, at the end of the reflector that is closer to the illumination system of the reflector;

two out the three points of hinging on the structure of the vehicle are positioned in points that are symmetrical with respect to the plane of symmetry of the antenna optics, as distant as possible, in the area between the reflector and the illumination system, and the third one is positioned on the plane of symmetry of the antenna optics, above the side of the illumination system that is farther from the reflector, such that the position and the orientation of the reflector relative to the vehicle depends on the length of the 6 supports.

In a preferred embodiment the isostatic deployable support structure for antenna reflectors is for space vehicles. Preferably the structure may be closed in a compact configuration, for stowage aboard a space vehicle, and subsequently deployed in a relative rigid, expanded configuration.

Preferably the isostatic deployable support structure for antenna reflectors is able to modify its configuration in orbit in order to change the geometry of the antenna optics and to modify its performance, including pointing.

In a preferred embodiment the isostatic deployable support structure for antenna reflectors is such that the widest beam projections compatible with radio frequency performance are accommodated.

In a preferred embodiment some or each of the six supports is at least partially made of hinged segments, in order to allow the deployment process.

In a preferred embodiment each of the six supports is totally or partially telescopic, in order to change its length both for the deployment process and for the displacement and the orientation of the reflector.

The invention will now be described with reference to explicative not limitative embodiments, also making reference to the following figures.

Figure 1:
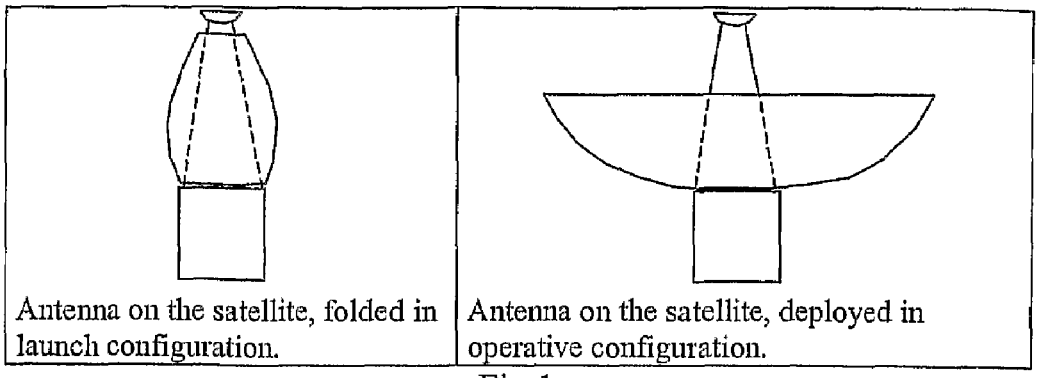
FIG. 1 shows a structure having a direct connection of the centre of the reflector to the body of the satellite, which is used for centred antennas of the "onset" type, out of the scope of the instant invention.
Figure 2:
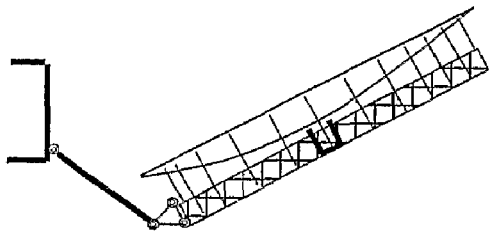
FIG. 2 shows a reflector support structure constituted by a single beam hinged at one end to the satellite and at the other end to the periphery of the reflector structure, out of the scope of the instant invention.
Figure 3:
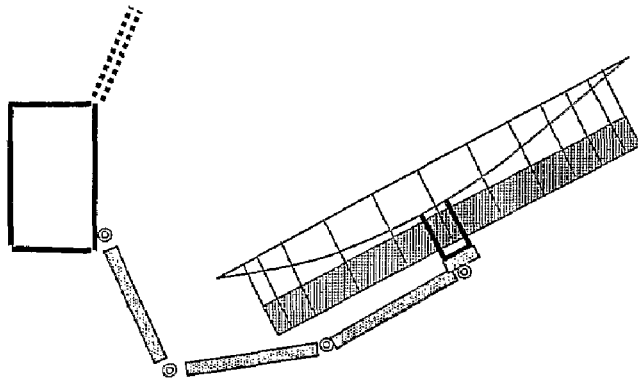
FIG. 3 shows a structure having a connection at the centre of the reflector in one point, out of the scope of the instant invention.
Figure 4:
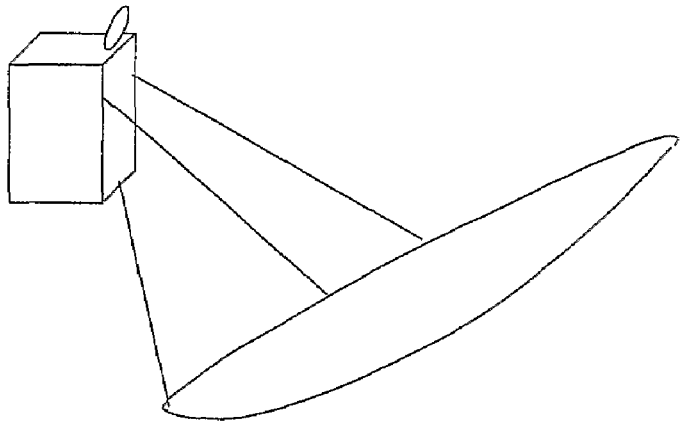
FIG. 4 shows a structure having a connection of the reflector to the satellite by means of 3 supports, out of the scope of the instant invention.
Figure 5:
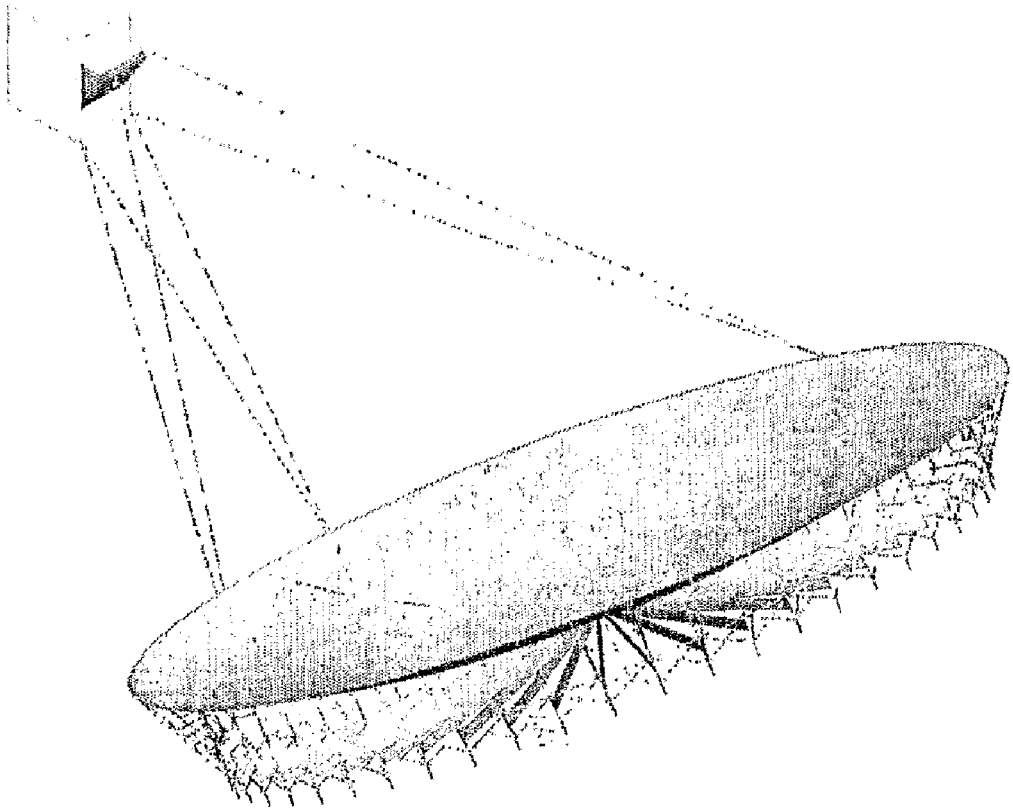
FIG. 5 shows the structure of the invention wherein the 6 supports are hinged in 3 points on the structure of the satellite and in 3 points on the structure of the reflector.

With regard to the 3 points of hinging on the structure of the reflector, two of them are positioned in points that are diametrically symmetrical with respect to the plane of symmetry of the antenna optics, and the third one is positioned on the plane of symmetry of the antenna optics, at the end of the reflector that is closer to the illumination system of the reflector.

With regard instead to the 3 points of hinging on the structure of the satellite, two of them are positioned in points that are symmetrical with respect to the plane of symmetry of the antenna optics, as distant as possible, in the area between the reflector and the illumination system, and the third one is positioned on the plane of symmetry of the antenna optics, above the side of the illumination system that is farther from the reflector.

Use of 6 supports hinged at their ends makes the system isostatic, with the following advantages:

The position and the orientation of the reflector relative to the satellite depends only on the length of the 6 supports;

The above point entails that the reflector can be displaced and/or rotated relative to the satellite and the illumination system, controlling the length of the supports.

The displacement and the rotation of the reflector in controlled manner and quantity enable to vary antenna performance, including pointing.

Temperature variations of the components do not induce internal stresses in the system.

The supports are subjected only to static traction and compression stress, not bending stress. This allows to use structures with small cross sections, maintaining the system light weight.

Having 3 junction points between the supports and the reflector, and the fact that such joints are not subject to bending stress, minimizes the strength and stiffness requirements for the structure of the reflector, maintaining the system light weight.

Moreover, additional peculiarities of the present invention are:

One of the two bodies of the Stewart platform (the reflector) changes its dimensions, in particular the distance between the three ball joints of the reflector is small when the reflector is folded and very large when the reflector is deployed.

The reconfiguration of the legs of the Stewart platform from the stowed to the deployed configuration determines the displacement of the reflector from the stowed position to the deployed position.

The same system used to change the length of the legs of the Stewart platform can be used to adjust its length and hence to re-orient or displace the reflector once it has been deployed to its final dimensions.

The invention claimed is:

1. Isostatic deployable support structure for antenna reflectors for vehicles characterized in that it is constituted by six supports hinged to each of their ends in three points on the structure of the vehicle and in three points on the structure of the reflector, in which:

two out of the three points of hinging on the structure of the reflector are positioned in points that are diametrically symmetrical with respect to the plane of symmetry of the antenna optics, and the third one is positioned on the plane of symmetry of the antenna optics, at the end of the reflector that is closer to the illumination system of the reflector;

two out the three points of hinging on the structure of the vehicle are positioned in points that are symmetrical with respect to the plane of symmetry of the antenna optics, as distant as possible, in the area between the reflector and the illumination system, and the third one is positioned on the plane of symmetry of the antenna optics, above the side of the illumination system that is farther from the reflector, such that the position and the orientation of the reflector relative to the vehicle depends on the length of the 6 supports.

2. Isostatic deployable support structure for antenna reflectors as claimed in claim 1, wherein said vehicles are space vehicles.

3. Isostatic deployable support structure for antenna reflectors as claimed in claim 2 characterized in that it is closed in a compact configuration, for stowage aboard a space vehicle, and subsequently deployed in a relative rigid, expanded configuration.

4. Isostatic deployable support structure for antenna reflectors as claimed in claim 1, able to modify its configuration in orbit in order to change the geometry of the antenna optics and to modify its performance, including pointing.

5. Isostatic deployable support structure for antenna reflectors as claimed in claim 1, such that the widest beam projections compatible with radio frequency performance are accommodated.

6. Isostatic deployable support structure for antenna reflectors as claimed in claim 1, wherein some or each of the six supports is at least partially made of hinged segments, in order to allow the deployment process.

7. Isostatic deployable support structure for antenna reflectors as claimed in claim 1, wherein each of the six supports is totally or partially telescopic, in order to change its length both for the deployment process and for the displacement and the orientation of the reflector.

* * * * *